US005254186A

United States Patent [19]

Downes et al.

[11] Patent Number: 5,254,186

[45] Date of Patent: Oct. 19, 1993

[54] NITROCELLULOSE PROPELLANT COMPOSITION

[75] Inventors: Thomas B. Downes; John D. M. Pearson, both of Ayrshire, Scotland

[73] Assignee: Royal Ordnance plc, United Kingdom

[21] Appl. No.: 466,703

[22] Filed: Dec. 20, 1989

Related U.S. Application Data

[63] Continuation of Ser. No. 230,666, Aug. 9, 1988, abandoned, which is a continuation of Ser. No. 81,816, Jul. 14, 1987, abandoned.

[30] Foreign Application Priority Data

Jul. 15, 1986 [GB] United Kingdom ..... 8617239

[51] Int. Cl.[5] ..... C06B 45/10

[52] U.S. Cl. ..... 149/19.4; 149/198; 149/96; 149/98; 149/100

[58] Field of Search ..... 149/19.8, 96, 98, 100, 149/19.4

[56] References Cited

U.S. PATENT DOCUMENTS

| | | | |
|---|---|---|---|
| 3,639,183 | 2/1972 | Crescenzo | 149/96 |
| 3,860,462 | 1/1975 | Sayles | 149/19.8 |
| 3,905,846 | 9/1975 | Berta | 149/19.8 |
| 4,243,444 | 1/1981 | Alley et al. | 149/98 |
| 4,416,712 | 11/1983 | Mönch et al. | 149/98 |
| 4,521,261 | 6/1985 | Davies | 149/19.8 |
| 4,608,102 | 8/1986 | Krampen et al. | 149/100 |
| 4,701,228 | 10/1987 | Lagreze et al. | 149/100 |
| 4,842,658 | 6/1989 | Boileau et al. | 149/96 |

FOREIGN PATENT DOCUMENTS

| | | |
|---|---|---|
| 1277192 | 6/1972 | United Kingdom . |
| 1279961 | 6/1972 | United Kingdom . |

*Primary Examiner*—Edward A. Miller

*Attorney, Agent, or Firm*—Cushman, Darby & Cushman

[57] ABSTRACT

Nitrocellulose propellant compositions are provided comprising zinc oxide as ballistic modifier, advantageously in conjunction with one or more conventional ballistic modifiers for example, lead or copper compounds such as lead stearate, lead acetophthalate, lead B-resorcylate and basic copper salicylate. The propellant compositions exhibit good quality plateau burning over a useful pressure range for a wide range of burning rates.

11 Claims, 5 Drawing Sheets

NITROCELLULOSE PROPELLANT COMPOSITION

This is a continuation of application Ser. No. 07/230,666, filed Aug. 9, 1988 which in turn is a continuation of application Ser. No. 07/081,816, filed Jul. 14, 1987 both now abandoned.

This invention relates to nitrocellulose (NC) based propellant composition containing ballistic modifier to produce the effect of plateau or mesa burning over significant ranges of pressure.

The preparation of nitrocellulose propellants is described in Chapter 17 of the book "High Explosives and Propellants" by S Fordham, 2nd Edition Pergamon Press 1980. The manufacture of cast double base nitrocellulose propellant is also described in United Kingdom patent specifications Nos. 827,012 and 1095471.

In general for a given ignition temperature the burning rate of a propellant in a combustion chamber is related to the pressure to which it is exposed in a manner which can be expressed mathematically by the expression $$r=kp^n$$

where r is the burning rate, p is the pressure and k and n are constants which are characteristic of the propellant. Thus r increases exponentially with increasing p and log r increases linearly with log p, the graph of log r against log p being a line of slope n. In conventional propellant without ballistic modifier, the pressure exponent n has a value of 0.5 to 0.8 and for rocket propulsion the progressive increase in burning rate with increasing pressure presents problems in designing motors to withstand the pressures which could be developed. In order to overcome this problem NC base propellant compositions containing ballistic modifiers have been developed, the modifier being effective to modify the burning rate and pressure relationship so that over a useful working pressure range the pressure exponent n is reduced. In the region where n=o the graph of log r against log p contains a flat portion, termed a "plateau" and the burning is termed "plateau burning". In some cases n is reduced to a negative value over a certain pressure range, such propellant burning being termed "mesa burning". Ballistic modifiers causing "plateau burning" or "mesa burning" are termed platonisation agents. Plateau burning propellants give reduced motor performance variability in the region of the plateau and mesa burning provides additional safety against the development of high pressure in the propellant container.

Ballistic modifiers (platonisation agents) commonly used include organic salts such as lead salicylate, lead stearate or lead B-resorcylate and may also include additional metal salts such as copper salicylate, copper stearate or copper benzoate. The use of such ballistic modifiers is described for example, in United States Patent Specifications 3088858, 3923564, United Kingdom Patent Specification 2121399 and Japanese Patent J55071690. For relatively fast burning propellants a favoured modifier comprises the reaction product of lead B-resorcylate and basic cupric salicylate as described in United States Patent Specifications Nos.3138499, 3994757, 3989776 and 4001287.

The currently used ballistic modifiers are deficient in some respects Thus platonised propellant compositions often exhibit poor reproducibility of plateaux characteristics from batch to batch, chemical instability on long term storage, combustion instability during burning and ballistic drift on storage. There is therefore a need for improved ballistic modified propellant compositions, especially for well platonised fast burning high energy compositions containing, when necessary, aluminium or high levels of energetic fillers such as a nitramine, for example RDX (cyclo 1,3,5-trimethylene 2,4,6-trinitramine).

We have now discovered that NC based propellants having improved plateau or mesa burning characteristics may be obtained by using ballistic modifier comprising zinc oxide. This modifier gives good quality plateaux which are reproducible from batch to batch and the modified propellants do not undergo ballistic drift on storage Zinc oxide, by itself, is an effective ballistic modifier for NC based propellants including cast and extruded double base propellant but it is advantageously used in conjunction with other ballistic modifiers such as lead B-resorcylate and lead salicylate to enhance the platonised burning rate. With such mixed ballistic modifiers the platonised burning rate of a propellant may be "tuned" to the requirements of a particular rocket motor and the burning rate even of high burning rate propellants may be increased, in some case by 19%. The modified propellants have improved chemical stability as reflected by improved crack test results. This is attributable to reaction between the zinc oxide and protic acid impurities present in the propellant composition which in the absence of zinc oxide cause degradation of nitric esters.

We have also discovered that the inclusion of zinc oxide as modifier in nitrocellulose propellants improves or eliminates combustion instability which is caused by acoustic resonance waves which build up in a rocket motor cavity during burning of the propellant and cause wide fluctuations in the pressure/time burning characteristics. The improvement is believed to be attributable to the zinc oxide, because of its high melting point, acting as a resonance suppressant.

Thus in accordance with the invention an NC based propellant composition comprises zinc oxide as ballistic modifier. Preferred compositions comprise a mixture of zinc oxide and one or more of the lead or copper compounds effective as ballistic modifier. Suitable lead and copper compounds for this purpose include lead stearate, lead citrate, lead phthalate, lead acetophthalate, lead salicylate, lead B-resorcylate, basic copper salicylate, copper B-resorcylate and copper oxide.

The propellant compositions of the invention preferably contain from 2 to 8.0% by weight of ballistic modifier and, when the modifier comprises a lead or copper compound acting as ballistic modifier in conjunction with zinc oxide, the composition should preferably contain 0.15 to 5.0% by weight of zinc oxide.

In addition to the nitrocellulose and ballistic modifier the propellant compositions of the invention may contain conventional propellant ingredients including NG (in double base propellant); stabilisers, for example paranitro N-methylaniline, 2-nitrodiphenylamine or resorcinol; plasticisers, for example sucrose octoacetate, triacetin or dibutylphthalate; energetic constituents, for example a nitramine such as RDX or metal powder such as aluminium; burning rate moderants, for example carbon black; lubricants, for example candelilla wax; polymeric binders, for example polycaprolactone crosslinked with isocyanate; flash suppressants, for example potassium nitrate and resonance suppressants, for example silicon carbide.

Platonised propellant compositions of the invention may vary over wide ranges of energy and burning rates. Thus useful composition may be formulated covering the energy range from about 800 calories/gm to 1200 calories/gm and burning rates from about 4 mm/sec to about 45 mm/sec The composition may be prepared by the conventional propellant manufacturing methods as appropriate for the respective types of nitrocellulose propellant.

The invention is further illustrated by the following Examples wherein all percentages are given by weight.

The Examples were batches of propellant having the compositions shown in Table 1 prepared by standard propellant manufacturing methods as described in Chapter 17 of the book "High Explosives and Propellants", by S Fordham, 2nd Edition Pergamon Press 1980. Apart from the zinc oxide the ingredients used were commonly used propellant constituents.

Examples 3-6 were cast double base propellants made by a standard method wherein a double base propellant powder containing most of the ingredients was prepared by a solvent incorporation method and subsequently mixed with a casting liquid containing about half of the nitroglycerine, all of the triacetin and part of the stabiliser. For testing the burning rates, slabs and end burning charges were cut from the cast propellant and burned in a motor at an initial temperature of 21° C. (unless otherwise indicated).

Examples 1 and 2 were made by the solvent process. The propellant of these Examples was extruded into 2 mm diameter×18 cm long strands which were surface inhibited by treatment with vinyl lacquer to leave a constant burning end-surface. The burning rates of the strands were measured over a range of pressures when the strands were burned from the untreated end-surface in a Crawford Bomb strand burning apparatus under a nitrogen atmosphere at an initial temperature of 21° C. (unless otherwise indicated).

EXAMPLE 1

Figure 1:
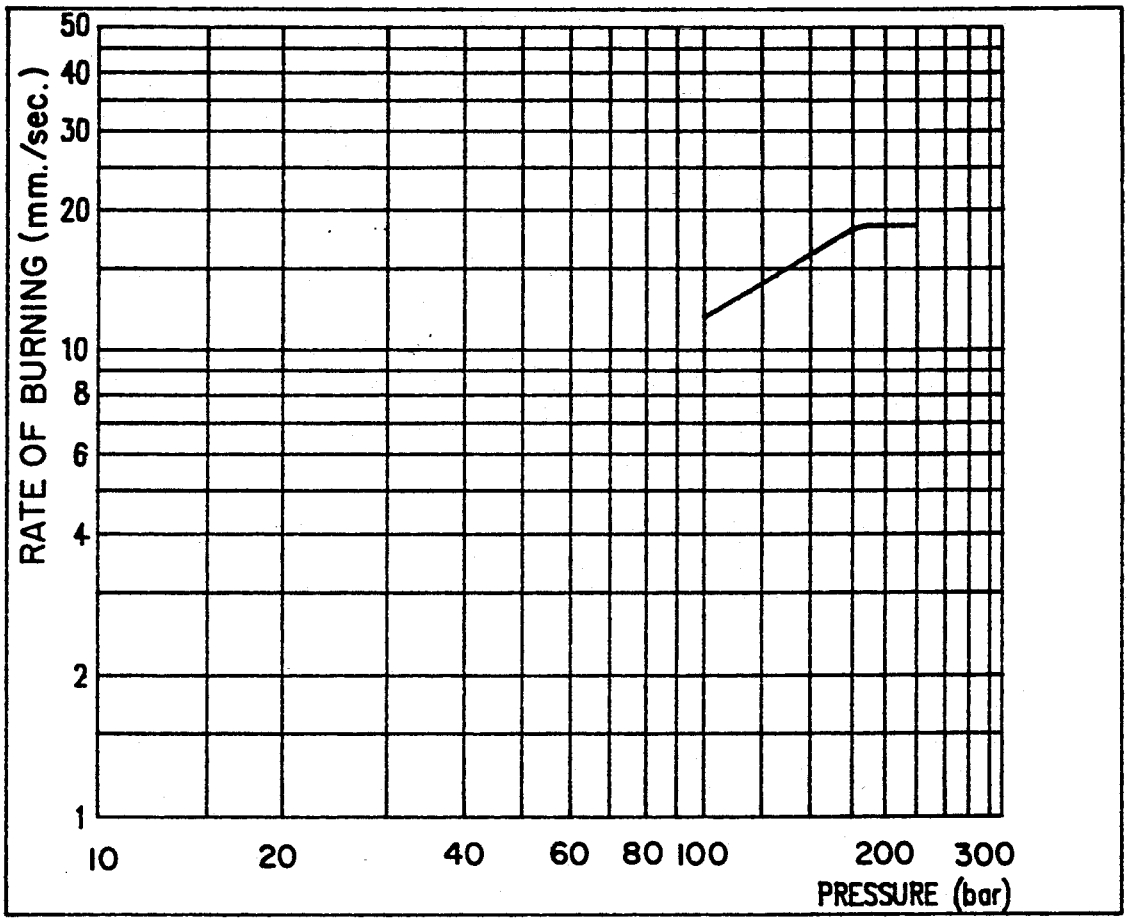
FIGS. 1-5 show ballistic properties of example compositions, including plateau effects for the invention compositions.

This Example was a platonized solvent extruded double base propellant composition containing 4.00% of zinc oxide as the sole ballistic modifier. The ballistic properties (burning rate v pressure) are shown graphically in FIG. 1 as a plot of log burning rate v. log pressure. The plot indicates that the zinc oxide gave a plateau burning rate of 18 mm/sec at a pressure range of 175-225 bar.

EXAMPLE 2

Figure 2:
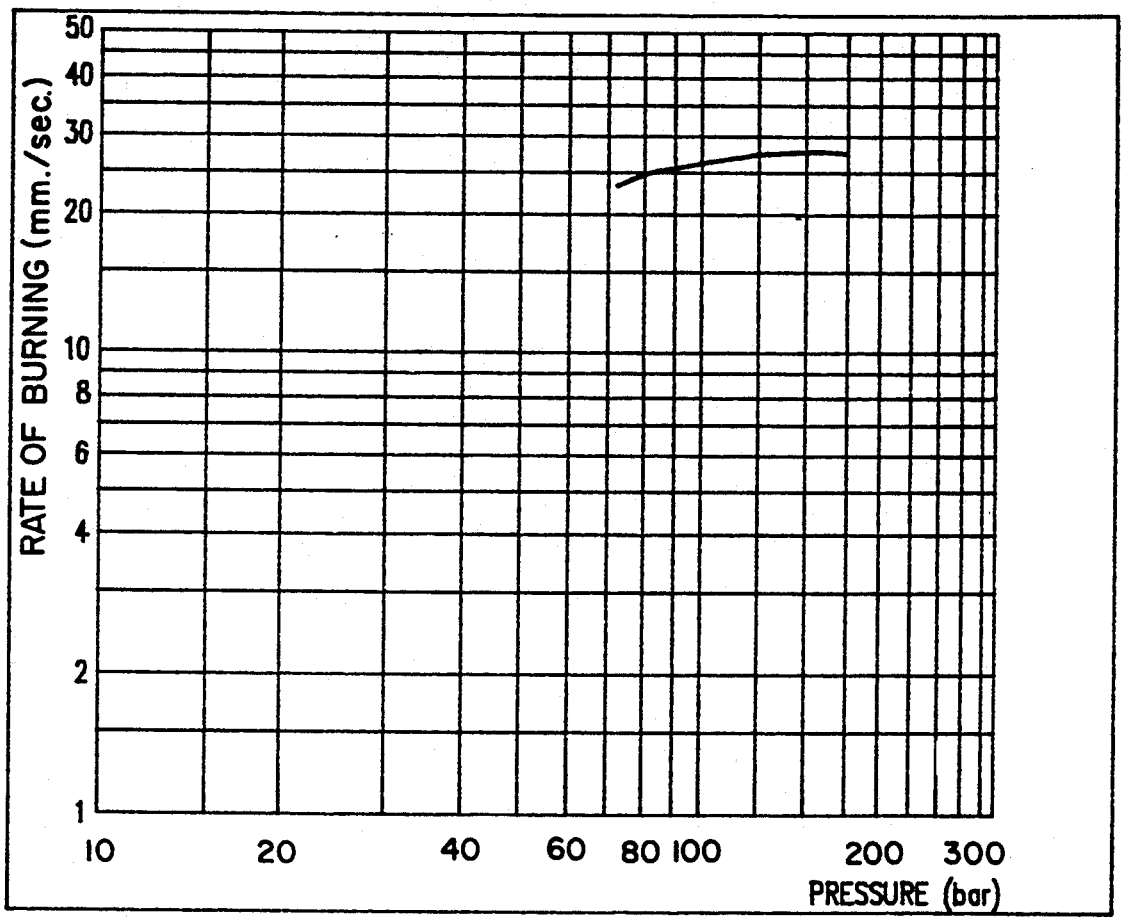

This Example was a platonised solvent extruded double base propellant having the same composition as Example 1 except that the ballistic modifier consisted of 2.0% of zinc oxide and 2.0% of lead B-resorcylate. The ballistic test results of this composition, shown graphically in FIG. 2, show that this composition exhibited plateau burning at a higher burning rate of about 27 mm/sec over a pressure range of about 85-200 bar.

EXAMPLES 3(a) and 3(b)

Figure 3:
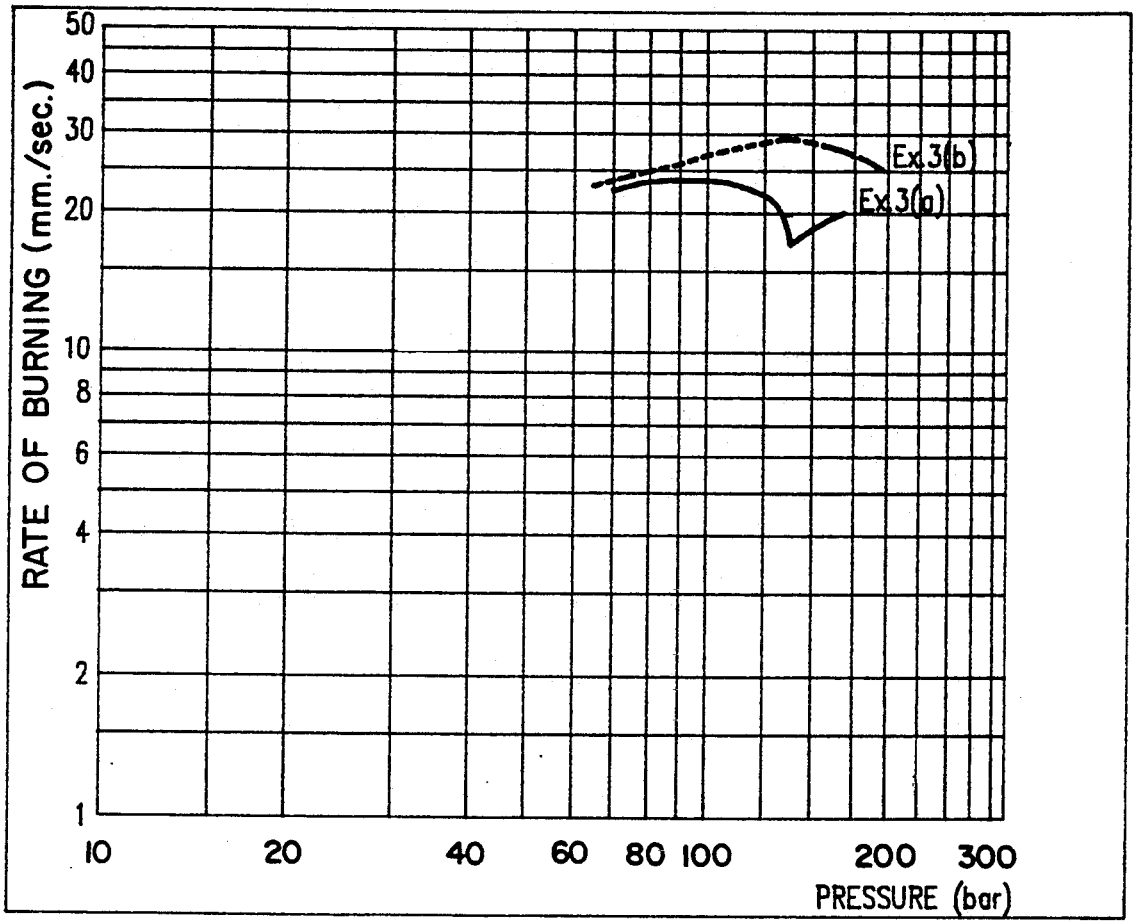

These Examples were platonised cast double base propellants having substantially the same composition except that Example 3(b) contained 0.34% of zinc oxide in addition to 1.99% of lead B-resorcylate and 1.99% of lead salicylate as ballistic modifier. The ballistic test results of these compositions are shown graphically in FIG. 3. These results show that the zinc oxide produced a higher burning rate plateau over an increased pressure range of about 80-175 bar.

Slabs of the compositions were stored at 60° C. for 12 weeks and the burning rates were again determined. Example 3(a) showed 7% downward ballistic drift over the storage period whereas Example 3(b) showed essentially unchanged ballistics, thus indicating the effect of the zinc oxide in preventing the downward ballistic draft usually attributed to reaction between the lead B-resorcylate and lead salicylate in the composition.

EXAMPLE 4

Figure 4:
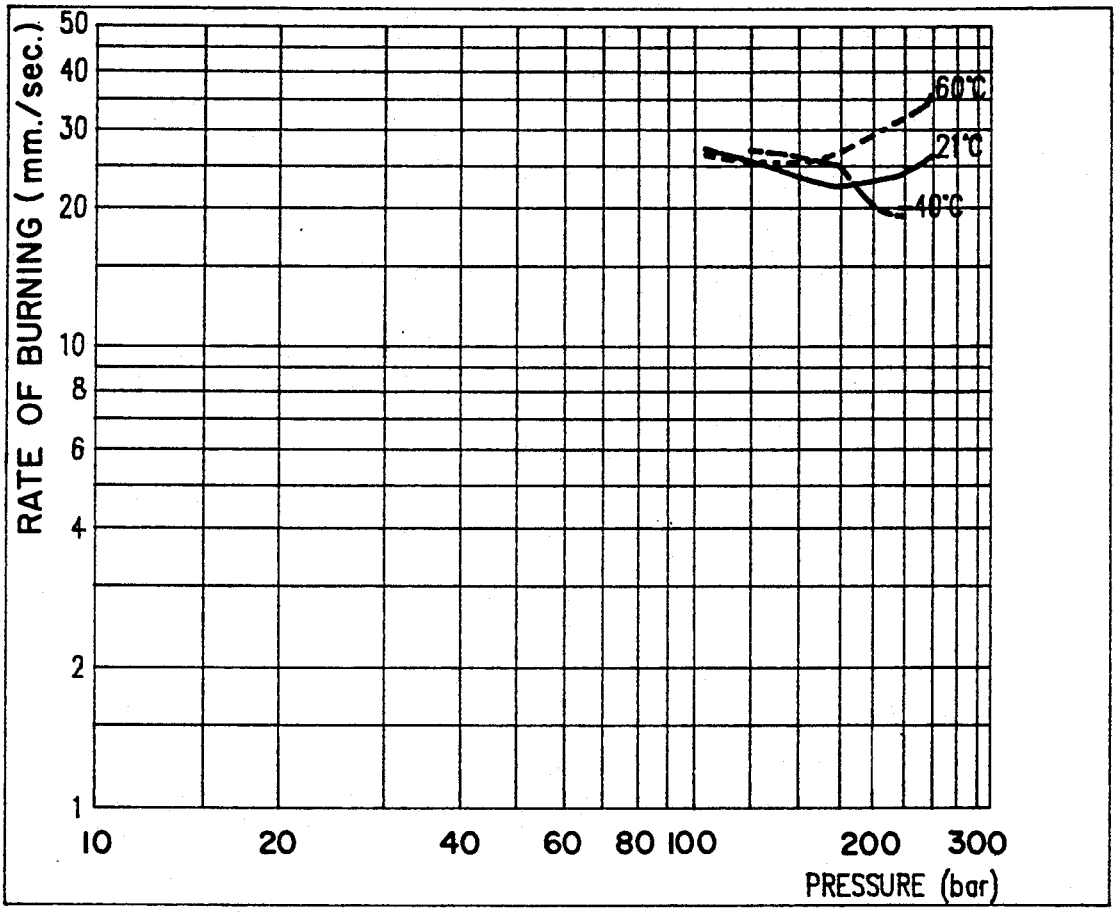

This Example was a platonised elastomer modified cast double case propellant composition containing 0.66% of zinc oxide, 1.98% of lead B-resorcylate, 1.98% of lead salicylate and 3.53% of a polymeric binder consisting of polycaprolactone crosslined with isocyanate. The burning rate tested at initial temperatures of −40°, 21° and 60° C. were 25-26 m/sec. in each case over a platonised burning range of 100-175 bar, as shown in FIG. 4.

The burning rate did not vary much with the initial temperature (i.e. the temperature coefficient was low) over the range −40° to 60° C. in the plateau burning region.

EXAMPLES 5(a) and 5(b)

These Examples were platonised aluminium filled cast double base propellants having substantially the same composition except that Example 5(b) contained 0.34% of zinc oxide. 5.1 cm. cubes of both compositions were stored at 80° C. and tested (by X-ray) for signs of cracks or internal flaws. Example 5(a) showed cracks after 8 days whereas Example 5(b) did not show any sign of cracking until 21 days.

EXAMPLE 6

Figure 5:
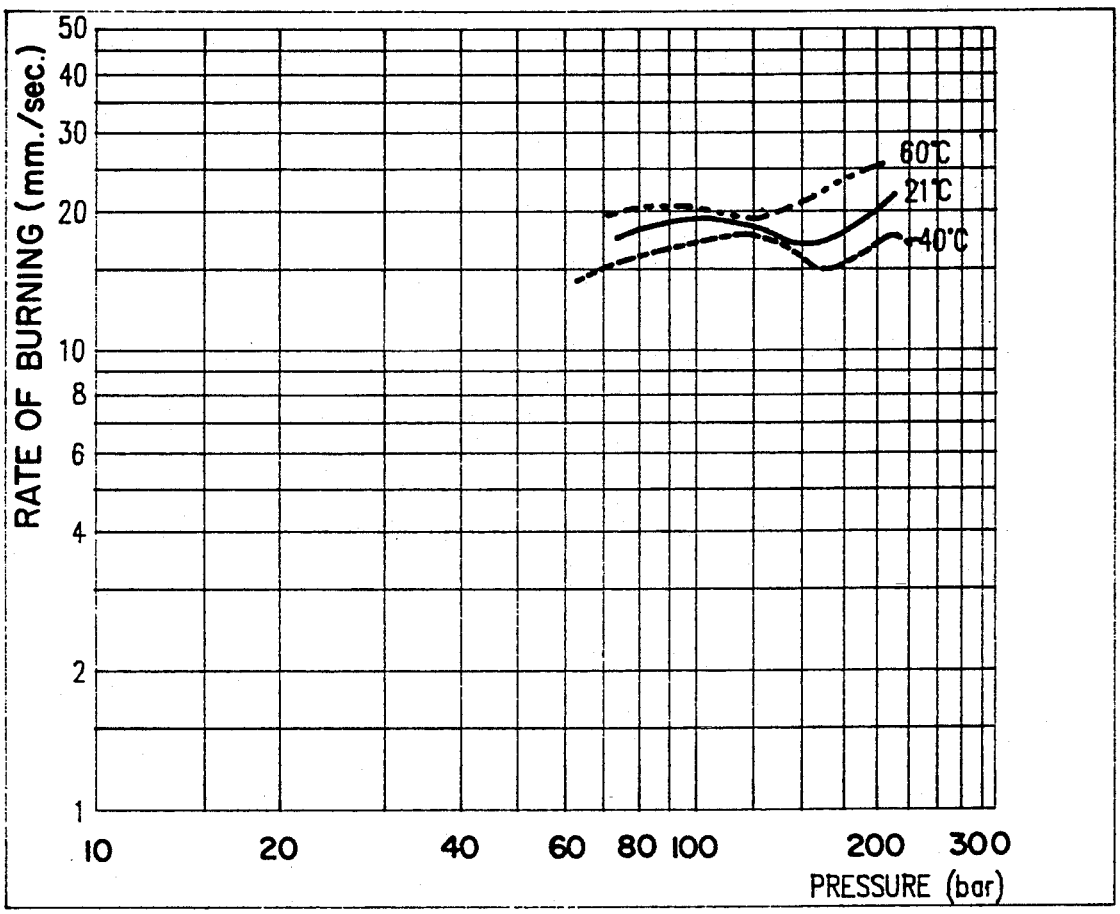

This Example was a platonised high energy elastomer modified cast double base propellant containing 0.21% zinc oxide, 3.21% of polymeric binder (as used in Ex. 4), 19.6% RDX and 1.4% silicon carbide. The ballistic test results shown in FIG. 5 indicate that plateau burning at about 20 mm/sec. with an acceptable (low) temperature coefficient occurs over the pressure range of 80-150 bar.

TABLE 1

| Example<br>Composition % | 1 | 2 | 3(a) | 3(b) | 4 | 5(a) | 5(b) | 6 |
|---|---|---|---|---|---|---|---|---|
| Nitrocellulose (12.6% N) | 40.50 | 40.50 | 40.09 | 39.89 | 26.47 | 35.57 | 35.40 | 21.15 |
| Nitroglycerine | 46.86 | 46.86 | 47.12 | 47.01 | 56.50 | 43.75 | 43.64 | 44.74 |
| p-nitro-N-methylaniline | 0.7 | 0.7 | 0.67 | 0.66 | 0.66 | 0.60 | 0.60 | 0.69 |
| 2-Nitrodiphenylamine | 0.3 | 0.3 | 0.33 | 0.33 | 0.33 | 0.33 | 0.33 | 0.30 |

TABLE 1-continued

| Example Composition % | 1 | 2 | 3(a) | 3(b) | 4 | 5(a) | 5(b) | 6 |
|---|---|---|---|---|---|---|---|---|
| Triacetin | 7.44 | 7.44 | 7.59 | 7.59 | 7.69 | 7.44 | 7.44 | 6.09 |
| Zinc oxide | 4.00 | 2.0 | — | 0.34 | 0.66 | — | 0.34 | 0.21 |
| Carbon black | 0.2 | 0.2 | 0.2 | 0.2 | 0.2 | 1.14 | 1.13 | 0.11 |
| Lead B-resorcylate | — | 2.0 | 2.0 | 1.99 | 1.98 | 4.02 | 4.0 | 1.25 |
| Lead salicylate | — | — | 2.0 | 1.99 | 1.98 | — | — | 1.25 |
| *Polymeric Binder | — | — | — | — | 3.53 | — | — | 3.21 |
| Aluminium | — | — | — | — | — | 4.56 | 4.54 | — |
| Basic cupric salicylate | — | — | — | — | — | 1.94 | 1.93 | — |
| Resorcinol | — | — | — | — | — | 0.65 | 0.65 | — |
| RDX | — | — | — | — | — | — | — | 19.6 |
| Silicon carbide | — | — | — | — | — | — | — | 1.4 |
| Preparation method | Solvent Extruded | Solvent Extruded | Cast | Cast | Cast | Cast | Cast | Cast |
| Platonised burning rate (mm./sec.) | 18 | 27 | 24 | 29 | 26 | — | — | 20 |
| Pressure range (bar) | 175–225 | 85–200 | 80–130 | 80–175 | 100–175 | — | — | 80–150 |
| Crack life (days at 80° C.) | — | — | — | — | — | 8 | 21 | — |

*Polycaprolactone crosslinked with isocyanate.

We claim:

1. In a nitrocellulose based propellant composition containing a platonizing ballistic modifier, the improvement comprising, as a platonizing ballistic modifier, zinc oxide, so as to provide reproducible plateaux, and to suppress acoustic resonance, said propellant composition being characterized in that it has improved plateau or mesa burning characteristics, does not undergo ballistic drift on storage and has improved chemical stability.

2. The propellant composition of claim 1 which also includes at least one compound selected from lead and copper compounds effective as a propellant ballistic modifier.

3. The propellant composition of claim 2 wherein said lead and copper compounds are selected from the group consisting of lead stearate, lead citrate, lead phthalate, lead acetophthalate, lead salicylate, lead β-resorcylate, basic copper salicylate, copper β-resorcylate and copper oxide.

4. The propellant composition o claim 1 wherein said platonizing ballistic modifier is present in an amount ranging from 2 to 8.0 weight percent.

5. The propellant composition of claim 4 containing 0.15 to 5.0 weight percent zinc oxide.

6. The propellant composition of claim 1 which also includes at least one adjuvant selected from a stabilizer, a plasticizer, a burning rate moderant, a lubricant, a flash suppressant and a polymeric binder.

7. The propellant composition of claim 6 wherein said adjuvant is selected from paranitro-N-methylaniline, 2-nitrodiphenylamine, resorcinol, sucrose octoacetate, triacetin, dibutylphthalate, carbon black, candelilla wax, polycaprolactone cross-lined with isocyanate, potassium nitrate and silicon carbide.

8. The propellant composition of claim 1 which also includes at least one energetic constituent selected from the group consisting of a nitramine and a metal powder.

9. The propellant composition of claim 8 wherein said nitramine is cyclo-1,3,5-trimethylene 2,4,6-trinitramine.

10. The propellant composition of claim 1 having energy in the range from 800 to 1200 calories/gm.

11. The propellant composition of claim 1 having a burning rate of 4 to 45 mm/sec.

* * * * *